US006198061B1

(12) United States Patent
Amari

(10) Patent No.: US 6,198,061 B1
(45) Date of Patent: Mar. 6, 2001

(54) SWITCH DEVICE

(75) Inventor: Takeyuki Amari, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/498,651

(22) Filed: Feb. 7, 2000

(30) Foreign Application Priority Data

Mar. 1, 1999 (JP) ..... 11-052426

(51) Int. Cl.[7] ..... H01H 13/70; H01H 9/00

(52) U.S. Cl. ..... 200/310; 200/313; 200/315; 200/317; 200/339; 200/553; 200/5 R

(58) Field of Search ..... 200/317, 315, 200/553, 339, 312, 310, 308, 5 R, 313

(56) References Cited

U.S. PATENT DOCUMENTS 3,222,474 * 12/1965 Fasola, Jr. ..... 200/67
3,225,156 * 12/1965 Sahrbacker ..... 200/67
3,653,136 * 4/1972 Ruppert ..... 40/28 R
4,543,563 * 9/1985 Wine ..... 340/365 S
5,087,798 * 2/1992 Rohde et al. ..... 200/5 A

FOREIGN PATENT DOCUMENTS 6-44857 2/1994 (JP) .
7-64688 3/1995 (JP) .
8-235961 9/1996 (JP) .
9-198176 7/1997 (JP) .

* cited by examiner

*Primary Examiner*—Michael Friedhofer
(74) *Attorney, Agent, or Firm*—Armstrong, Westerman, Hattori, McLeland & Naughton

(57) ABSTRACT

A switch device is provided, in which a transparent key-top is arranged over a screen of a display unit so that information displayed on the screen of the display unit is seen through the key-top. The switch device is characterized by containing a shaft supporter provided in a space formed at both sides of the key-top for allowing the key-top to perform a seesaw-movement, wherein the space is formed by cutting off both sides of the key-top in an oblique direction so as to make an area of a face of the key-top larger than an area of a back of the key-top. Thus, the switch device achieves a seesaw-type key-top enabling a multiple display and improves visibility and operability for the seesaw-type key-top.

24 Claims, 5 Drawing Sheets

SWITCH DEVICE

BACKGROUND OF THE INVENTION (1) Field of the Invention

This invention relates to a switch device, in which information displayed on a screen of a display unit is seen through a transparent key-top, more specifically, to a switch device employing a seesaw-type key-top to be provided on an electronic display unit such as a liquid crystal display and an electro luminescent display.

(2) Description of the Related Art

Many switch devices having transparent key-tops through which information displayed on a screen of a display unit is seen, have hitherto been proposed. Some of these switch devices are disclosed in Japanese Patent Application laid-Open No. H644857, H7-64688, H8-235961 and H9-198176.

For example, as illustrated in FIG. 7, a conventional switch device 100 is constructed in a manner such that a transparent key-top 120 is arranged over a screen of a display unit 110, in which information 111 (for example, a symbol indicating a function allotted to the key-top 120) displayed on the screen of the display unit 110 can be seen through the key-top 120.

The key-top 120 is resiliently fitted into a case 130 using a spring and can be pushed downward. An image guide 121 (a block composed of bundled optical fibers), which guides information displayed on the screen of the display unit 110 to the vicinity of the key-top 120, is provided between the display unit 110 and the key-top 120.

According to this conventional switch device, when a plurality of functions are allotted to the key-top 120, the information 111 displayed on the screen of the display unit 110 is changed corresponding to a change of the functions so that the symbol of the key-top 120 can be changed accordingly, allowing a multiple display by the single key-top 120.

There are two types of general key-tops, a simple push-type (single push-type) as shown in FIG. 8A and a seesaw-type (double push-type) as shown in FIG. 8B. Regarding the conventional switch device, which is constructed in such a manner that a transparent key-top is arranged over a screen of a display unit, every key-top has been a simple push-type. A switch device equipped with a seesaw-type key-top has not been employed.

There are two reasons why a switch device equipped with a seesaw-type key-top has not been employed. One reason is that, as shown in FIGS. 9A and 9B, a seesaw-movement of a transparent key-top 140 requires that a center of the key-top 140 should be rotatively supported and, accordingly, that a space L1 is provided to receive a rotary shaft 141 and a bearing (not shown) between each adjacent key-top 140. However, it has been impossible to arrange a plurality of the key-tops 140 adjacently within a limited space over the screen of the display unit 110.

Another reason is that, as shown in FIG. 10, a pair of tactile switches 151 and 152 are needed to allow the transparent key-top 140 to be operable in two directions, such that the key-top 140 protrudes excessively from a face of the display unit 110, since a distance between the key-top 140 and the display unit 110 undesirably increases from L2 to L2+L3, where L2 is a height of the key-top 140 and L3 a height of the tactile switches 151 and 152.

Consequently, with vehicle-mounted equipment, in which the key-top 140 is seen from an oblique direction, a visual angle of information displayed on the screen of the display unit 110 cannot be ensured, resulting in a problem that the information displayed on the screen of the display unit 110 cannot be seen by an operator.

Thus, it has been impossible to realize the switch device equipped with a seesaw-type key-top that enables a multiple display and can be used for various purposes such as an equalizer, balancer and fader in a car-audio system, for example.

SUMMARY OF THE INVENTION

It is therefore an object of the present invention to solve the above-mentioned problems and to provide a switch device that provides a seesaw-type key-top enabling a multiple display and improves visibility and operability for the seesaw-type key-top.

In order to achieve the above object, a first aspect of the present invention is to provide a switch device, in which a transparent key-top is arranged over a screen of a display unit so that information displayed on the screen of the display unit is seen through the key-top, the switch device comprising a shaft supporter provided in a space formed at both sides of the key-top for allowing the key-top to perform a seesaw-movement, wherein the space is formed by cutting off both sides of the key-top in an oblique direction so as to make an area of a face of the key-top to be larger than an area of a back of the key-top.

The second aspect of the present invention is to provide the switch device, wherein the space is formed by cutting off a portion of both sides of the key-top in an oblique direction, except for an effective displaying portion defined by an angle of vision.

The third aspect of the present invention is to provide the switch device, wherein each hollow receiving a corresponding tactile switch therein is provided at both ends of the back of the key-top so that one of the tactile switches is pushed downward when the key-top is in a seesaw-movement.

The fourth aspect of the present invention is to provide the switch device, wherein a plurality of the key-tops are arranged in parallel over the screen of the display unit and a lattice-shaped covering sheet corresponding to the space at both sides of each key-top is provided between the screen of the display unit and each key-top.

The fifth aspect of the present invention is to provide the switch device, wherein both cut sides of the key-top are treated to be nonpermeable for light.

The sixth aspect of the present invention is to provide the switch device, wherein a portion of both ends of the face of the key-top, except an effective displaying portion defined by an angle of vision, is treated to be nonpermeable for light and used as an operating portion.

The seventh aspect of the present invention is to provide the switch device, wherein information responding to a double operation of the key-top is displayed directly under the key-top over the screen of the display unit.

The eighth aspect of the present invention is to provide the switch device, wherein information showing a function allotted to the key-top is displayed directly under the key-top over the screen of the display unit.

The switch device according to the present invention achieves a seesaw-type key-top enabling a multiple display and, in addition, improves visibility and operability for the seesaw-type key-top.

DESCRIPTION OF THE PREFERRED EMBODIMENTS

In the following, the preferred embodiments of the present invention are explained with reference to the attached drawings.

Figure 1:
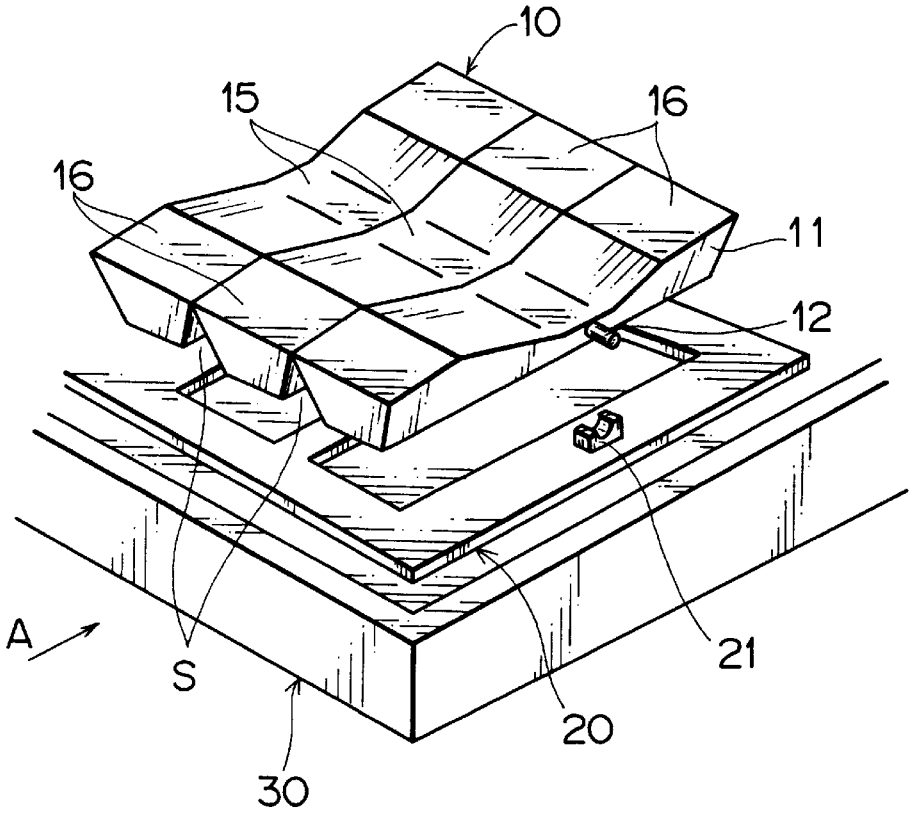
FIG. 1 is a perspective view illustrating a primary part of a switch device according to the present invention.
Figure 2:
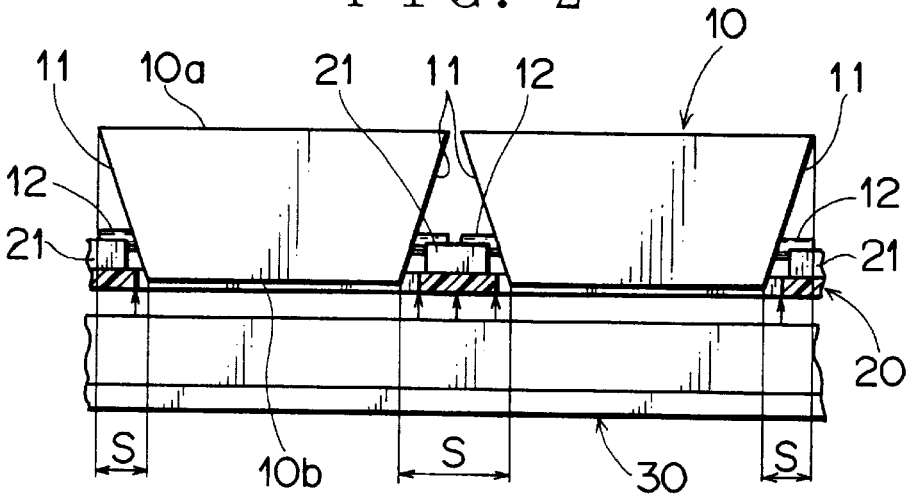
FIG. 2 is a view from arrow A of the switch device shown in FIG. 1.

FIG. 1 is a perspective view illustrating a primary part of a switch device according to the present invention. FIG. 2 is a view from arrow A of the switch device shown in FIG. 1.

As shown in FIG. 1, a switch device according to the present invention is constructed in such a manner that a plurality of transparent key-tops 10 are arranged in parallel over a screen of a single display unit 30, wherein a character, figure and symbol indicated on the screen of the display unit 30 corresponding to each key-top 10 are seen through each key-top 10 (see FIG. 6). A lattice-shaped covering sheet 20 is provided between each key-top 10 and the display unit 30 to prevent a mutual leakage of light among each key-top 10.

As shown in FIG. 2, each key-top 10 is cut at both sides 11 thereof in an oblique direction so as to make an area of a face 10*a* of the key-top larger than that of the back 10*b* thereof, thereby allowing a space S to be formed at both sides of each key-top 10.

In addition, in order to allow each key-top 10 to perform a seesaw-movement, a rotary shaft 12 is provided at both sides 11 of each key-top 10, and each bearing 21 for supporting the rotary shaft 12 is provided on the covering sheet 20. These rotary shafts 12 and bearings 21 are received in the space S formed at both sides of each key-top 10.

Figure 3A:
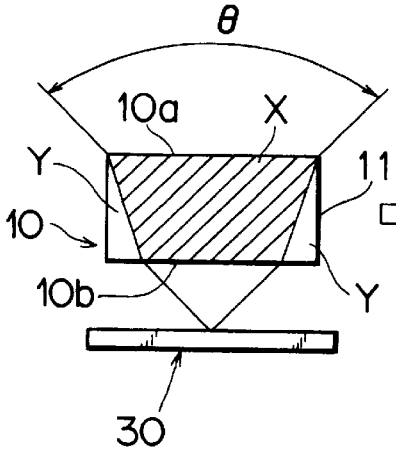
FIGS. 3A and 3B are conceptual views illustrating states before and after, respectively, cutting of both sides of a key-top of the switch device.
Figure 3B:
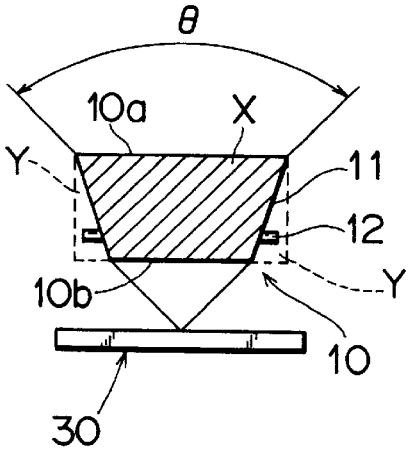

FIGS. 3A and 3B are conceptual views illustrating states before and after, respectively, cutting of both sides of a key-top 10 of the switch device 1, and each diagonally shaded area in the figures corresponds to an effective displaying portion X defined by an angle θ of vision.

As shown in FIG. 3A, portions Y, except the effective displaying portion X, with respect to both sides 11 of the key-top 10 are unnecessary portions that exert no influence on visibility for information on a screen of the display unit 30, which is seen through the key-top 10. Consequently, the portions Y, except the effective displaying portion X, are cut so that the space S is formed.

Figure 4:
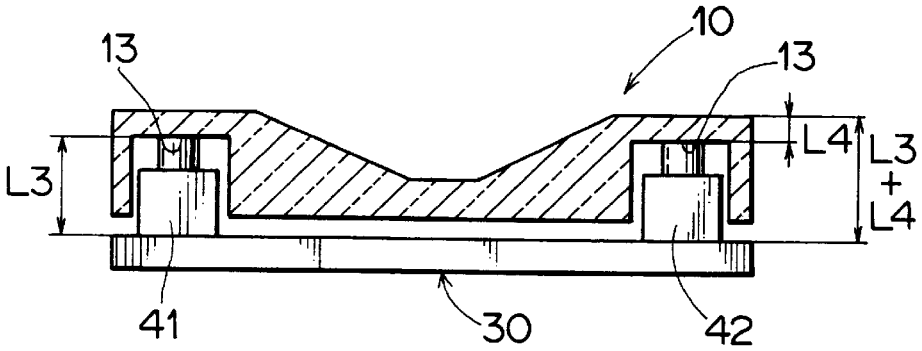
FIG. 4 is a cross-sectional side view of the key-top.

FIG. 4 is a cross-sectional side view of the key-top 10. A pair of hollows 13, for receiving a corresponding tactile switch 41 or 42 therein, are provided at both ends of the back of the key-top 10. When the key-top 10 is in a seesaw-movement, one of these tactile switches is pushed downward.

Figure 5:
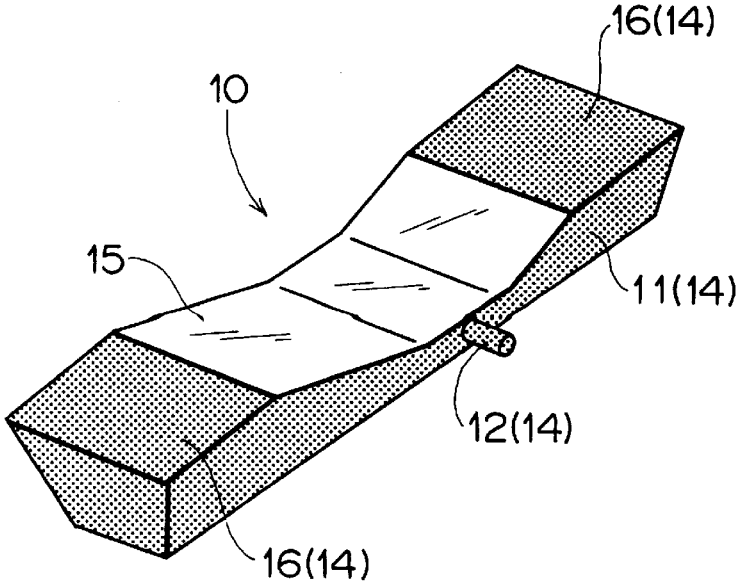
FIG. 5 is a perspective view illustrating portions of the key-top, which are treated to be nonpermeable for light.

FIG. 5 is a perspective view illustrating portions of the key-top 10, which are treated to be nonpermeable for light. Portions of both ends of the face of the key-top 10, except an effective displaying portion (displaying portion 15, in this case) defined by an angle of vision, are treated to be nonpermeable for light by coating in black (14) and provide an operating portion 16. In addition, both cut sides 11 of the key-top 10 and the rotary shaft 12 are treated to be nonpermeable for light by coating in black (14).

Figure 6A:
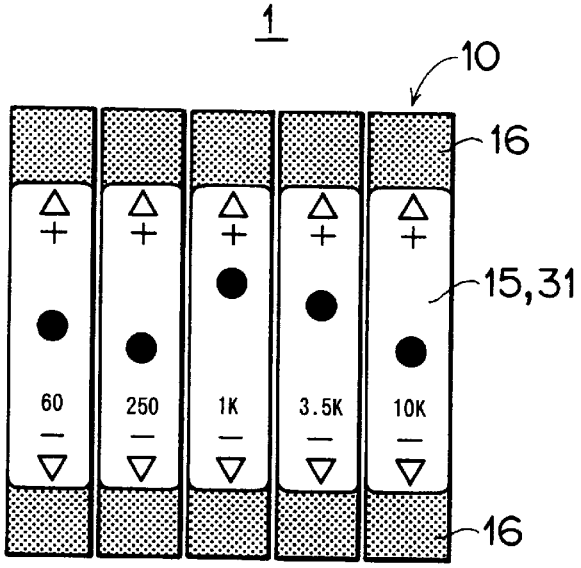
FIGS. 6A and 6B are schematic representations of a graphic equalizer, balancer and fader, respectively; illustrating displayed forms thereof when the switch device is applied to a car-audio system.
Figure 6B:
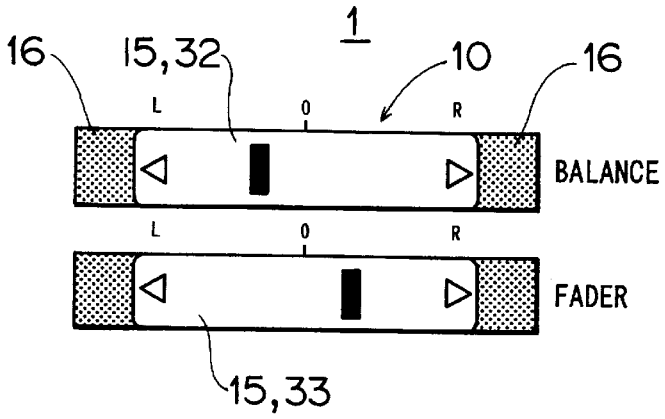
Figure 8A:
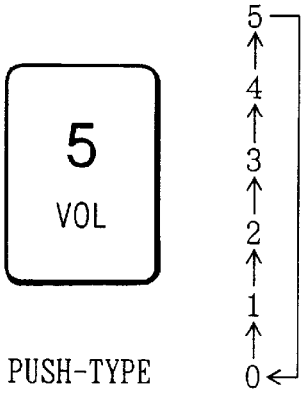
FIG. 8A PRIOR ART
FIGS. 8A and 8B are schematic representations illustrating operations of a conventional simple push-type and seesaw-type key-tops, respectively.
Figure 8B:
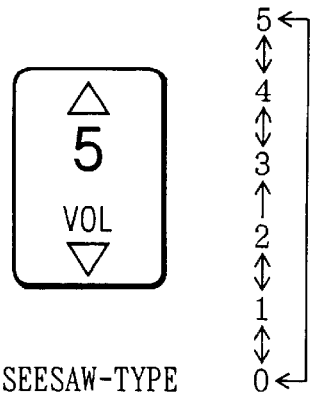
FIG. 8B PRIOR ART
Figure 7:
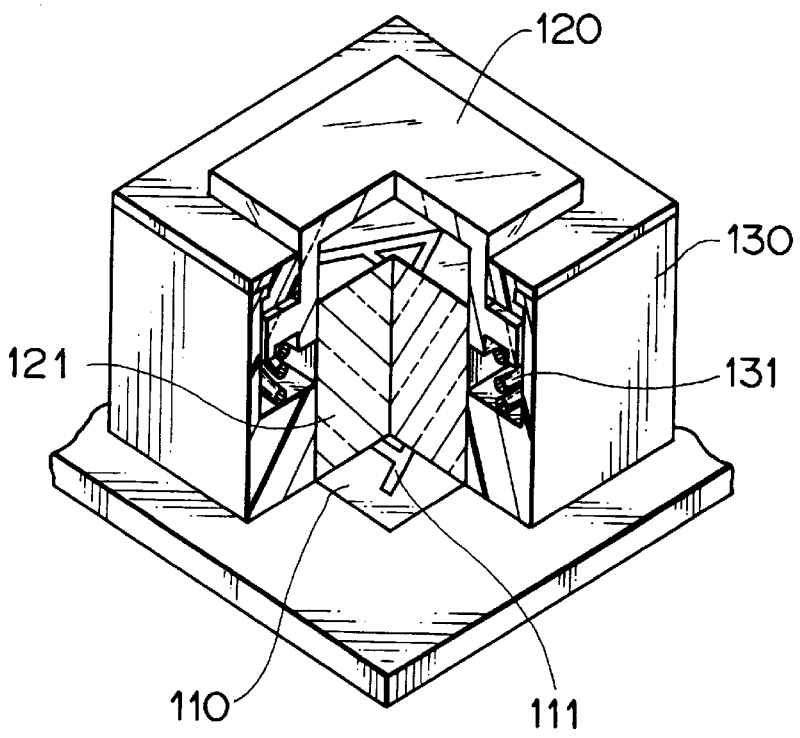
FIG. 7 PRIOR ART
FIG. 7 is a perspective view, with a portion cut away, illustrating a conventional switch device equipped with a simple push-type key-top enabling a multiple display.
Figure 10:
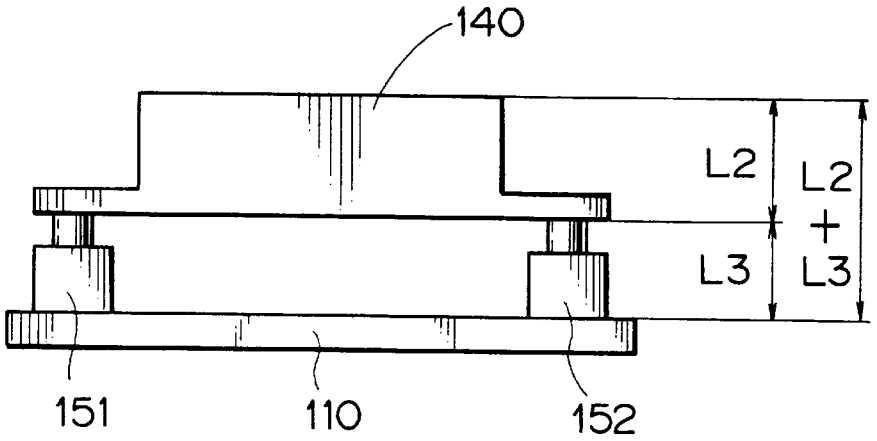
FIG. 10 PRIOR ART
FIG. 10 is a side view of a conventional switch device illustrating a problem arising when attempting use of a seesaw-type key-top enabling a multiple display.
Figure 9A:
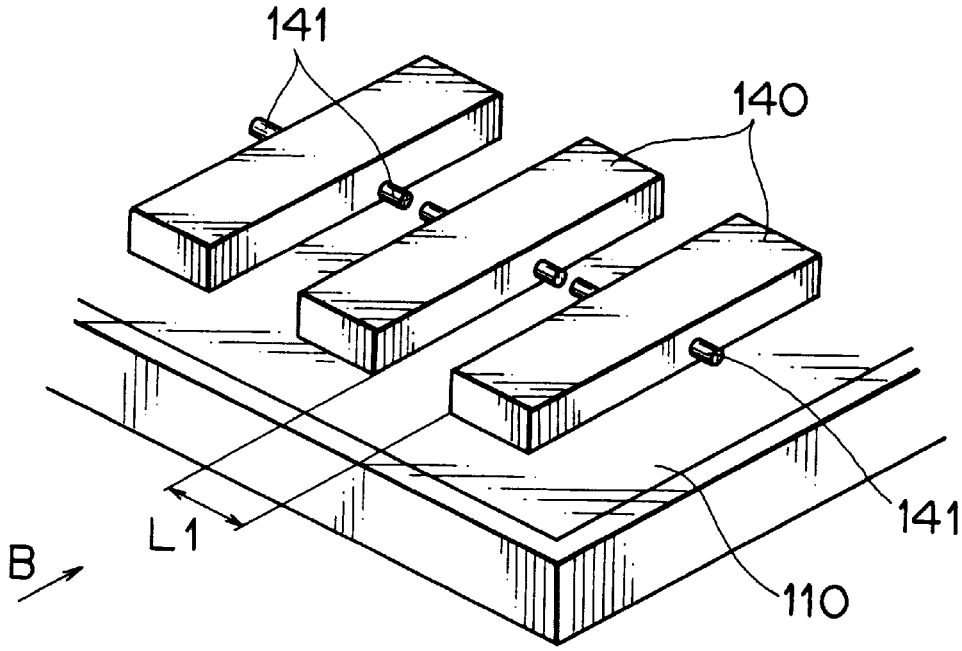
FIG. 9A PRIOR ART
FIGS. 9A and 9B are perspective views of a conventional switch device and a view from arrow B of the switch device shown in FIG. 9A, respectively, both illustrating a problem arising when attempting use of a seesaw-type key-top enabling a multiple display.
Figure 9B:
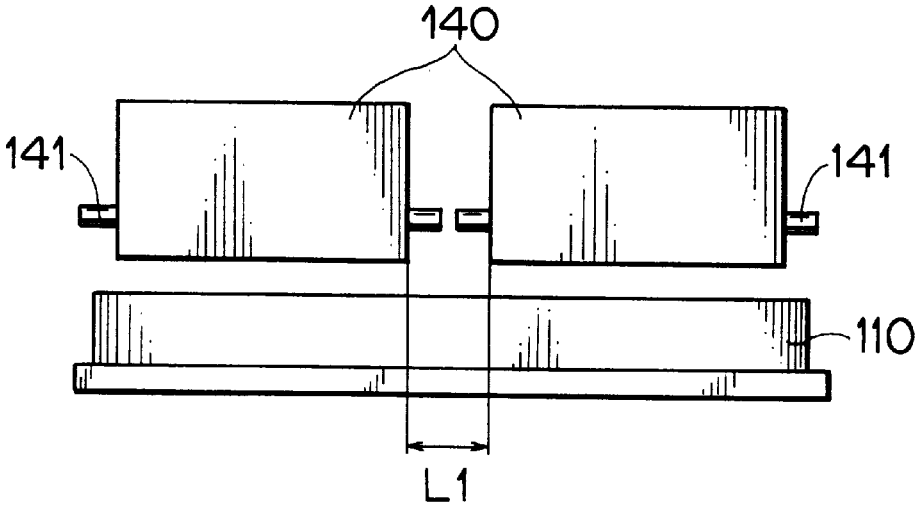
FIG. 9B PRIOR ART

FIGS. 6A and 6B are schematic representations illustrating displayed forms when the switch device 1 is applied to a car-audio system.

FIG. 6A illustrates a graphic equalizer of a car-audio system, to which the switch device 1 is applied, and level information 31 corresponding to each divided frequency range are displayed directly under each key-top 10 over the screen of the display unit 30 (see FIG. 1). When each key-top 10 is operated by pushing either the upper portion (+side) or the lower portion (−side) of the key-top 10, each point (black circle) in the level information 31 is shifted, such that the above operation is reflected on the information.

FIG. 6B illustrates a balancer and fader of a car-audio system, to which the switch device 1 is applied, and level information 32 and 33 corresponding to the balancer and fader, respectively, are displayed directly under each key-top 10 over the screen of the display unit 30 (see FIG. 1). When each key-top 10 is operated by pushing downward either the right portion (R side) or the left portion (L side) of the key-top 10, each point (black rectangle) in the level information 32 and 33 is shifted, such that the above operation is reflected on the information.

According to the aforementioned switch device 1 of the present invention, as shown in FIGS. 1 and 2, the space S for receiving the rotary shafts 12 and the bearings 21 is formed by cutting both sides 11 of the key-top 10 off in an oblique direction so as to make the area of the face 10*a* of the key-top 10 larger than the area of the back 10*b* thereof, enabling each key-top 10 to be arranged adjacently and closely. Consequently, an area occupied by the key-top 10 over the screen of the display unit 30 can be minimized.

In addition, as shown in FIGS. 3A and 3B, the space S can be formed by cutting the unnecessary portions Y at both sides 11 of the key-top 10 without reducing the effective displaying portion X, i.e., without reducing the angle θ of vision with respect to information on the screen of the display unit 30, which is seen through each key-top 10.

Furthermore, as shown in FIG. 4, the pair of hollows 13 receiving the corresponding tactile switch 41 or 42 therein are provided at both ends of the back of the key-top 10, enabling the switch structure composed of the key-top 10 and the tactile switches 41 and 42 to be thin, i.e., the protrusion of the key-top 10 is decreased, since only L4 due to a small thickness of the key-top 10 is added to the height L3 of the tactile switch 41 or 42 regarding the whole height of the key-top 10 from the screen of the display unit 30.

According to the aforementioned effects of the present invention, a seesaw-type key-top 10 enables a multiple display.

As shown in FIG. 5, both ends of the face of the key-top 10, which are treated to be nonpermeable for light, are used as operating portions 16, preventing a fingerprint from adhering to the transparent displaying portion 15 of the key-top 10 and resulting in superior visibility for information on the screen of the display unit 30, which is seen through the displaying portion 15. The improvement in visibility brings improvement in operability.

As shown in FIGS. 1, 2, and 5, the lattice-shaped covering sheet 20 corresponding to the space S at both sides of the key-top 10 is provided between the screen of the display unit 30 and each key-top 10, and both cut sides 11 of each key-top 10 are treated to be nonpermeable for light, such that the mutual leakage of light between the key-tops 10 is effectively prevented and the visibility is superior for information on the screen of the display unit 30, which is seen through each key-top 10. Again, the improvement in visibility brings improvement in operability.

Due to these effects of the present invention, the seesaw-type key-top 10 enables a multiple display, and in addition, the visibility and operability for the seesaw-type key-top 10 are improved.

As shown in FIGS. 6A and 6B, the information, introduced by a double operation on the key-top 10, such as the level information 31, 32 and 33 corresponding to the graphic equalizer, balancer and fader, respectively, are displayed corresponding to the key-top 10, resulting in a new form of display being provided and necessity of a separate display of the level information 31, 32 and 33 on the screen of the display unit 30 is eliminated.

The switch device according to the present invention is not limited to the aforementioned embodiments.

In FIGS. 6A and 6B, the information (level information 31, 32 and 33) introduced by the double operation on the key-top 10 is displayed directly under each key-top 10 over the screen of the display unit 30. However, the above construction may be replaced by a construction in which symbols such as a character, figure and symbol indicating functions allotted to each key-top are displayed directly under each key-top 10 over the screen of the display unit 30, i.e., a construction normally employed for a multiple display using a push-type key-top. According to the latter construction, various symbols such as an air-conditioner can be separately displayed corresponding to each key-top 10 so that a multiple display can be achieved by using the seesaw-type key-top 10.

What is claimed is:

1. A switch device in which a transparent key-top, having two sides, with a rotary shaft on each of the sides, and two ends, is arranged over a screen of a display unit so that information displayed on the screen of the display unit is seen through the key-top, said switch device comprising a shaft supporter provided in a space formed at both said sides of the key-top, in which said rotary shafts are rotatable supported, for allowing the key-top to perform a seesaw-movement, the space being formed by cutting off both said sides of the key-top in an oblique direction so as to make an area of a face of the key-top larger than an area of a back of the key-top.

2. The switch device according to claim 1, wherein the space is formed by cutting off a portion of both of the sides of the key-top in an oblique direction.

3. The switch device according to claim 2, wherein a hollow is formed at both of the ends of the back of the key-top, and each of the hollows receives a corresponding tactile switch therein so that one of said tactile switches is pushed downward when the key-top is in the seesaw-movement.

4. The switch device according to claim 3, wherein a plurality of key-tops are arranged in parallel over the screen of the display unit and a lattice-shaped covering sheet corresponding to the space at both of the sides of each of the key-tops is provided between the screen of the display unit and each of the key-tops.

5. The switch device according to claim 3, wherein both of the sides of the key-top are treated to be nonpermeable for light.

6. The switch device according to claim 3, wherein a portion of both of the ends of the face of the key-top are treated to be nonpermeable for light and used as an operating portion.

7. The switch device according to claim 3, wherein information responding to a double operation of the key-top is displayed directly under the key-top over the screen of the display unit.

8. The switch device according to claim 3, wherein information indicating a function allotted to the key-top is displayed directly under the key-top over the screen of the display unit.

9. The switch device according to claim 2, wherein a plurality of key-tops are arranged in parallel over the screen of the display unit and a lattice-shaped covering sheet corresponding to the space at both of the sides of each of the key-tops is provided between the screen of the display unit and each of the key-tops.

10. The switch device according to claim 2, wherein both of the sides of the key-top are treated to be nonpermeable for light.

11. The switch device according to claim 2, wherein a portion of both of the ends of the face of the key-top are treated to be nonpermeable for light and used as an operating portion.

12. The switch device according to claim 2, wherein information responding to a double operation of the key-top is displayed directly under the key-top over the screen of the display unit.

13. The switch device according to claim 2, wherein information indicating a function allotted to the key-top is displayed directly under the key-top over the screen of the display unit.

14. The switch device according to claim 1, wherein a hollow is formed at both of the ends of the back of the key-top, and each of the hollows receives a corresponding tactile switch therein so that one of said tactile switches is pushed downward when the key-top is in the seesaw-movement.

15. The switch device according to claim 14, wherein a plurality of key-tops are arranged in parallel over the screen of the display unit and a lattice-shaped covering sheet corresponding to the space at both of the sides of each of the key-tops is provided between the screen of the display unit and each of the key-tops.

16. The switch device according to claim 14, wherein both of the sides of the key-top are treated to be nonpermeable for light.

17. The switch device according to claim 14, wherein a portion of both of the ends of the face of the key-top are treated to be nonpermeable for light and used as an operating portion.

18. The switch device according to claim 14, wherein information responding to a double operation of the key-top is displayed directly under the key-top over the screen of the display unit.

19. The switch device according to claim 14, wherein information indicating a function allotted to the key-top is displayed directly under the key-top over the screen of the display unit.

20. The switch device according to claim 1, wherein a plurality of key-tops are arranged in parallel over the screen of the display unit and a lattice-shaped covering sheet corresponding to the space at both of the sides of each of the key-tops is provided between the screen of the display unit and each of the key-tops.

21. The switch device according to claim 1, wherein both of the sides of the key-top are treated to be nonpermeable for light.

22. The switch device according to claim 1, wherein a portion of both of the ends of the face of the key-top are treated to be nonpermeable for light and used as an operating portion.

23. The switch device according to claim 1, wherein information responding to a double operation of the key-top is displayed directly under the key-top over the screen of the display unit.

24. The switch device according to claim 1, wherein information indicating a function allotted to the key-top is displayed directly under the key-top over the screen of the display unit.

* * * * *